US008128754B2

(12) United States Patent
Madi et al.

(10) Patent No.: US 8,128,754 B2
(45) Date of Patent: Mar. 6, 2012

(54) FERRIC PICKLING OF SILICON STEEL

(75) Inventors: Vijay N. Madi, Mason, OH (US); Amanda Glass, Springboro, OH (US); Ronald Rodabaugh, Fairborn, OH (US)

(73) Assignee: AK Steel Properties, Inc., West Chester, OH (US)

( * ) Notice: Subject to any disclaimer, the term of this patent is extended or adjusted under 35 U.S.C. 154(b) by 0 days.

(21) Appl. No.: 12/616,847

(22) Filed: Nov. 12, 2009

(65) Prior Publication Data

US 2010/0122712 A1 May 20, 2010

Related U.S. Application Data

(60) Provisional application No. 61/114,660, filed on Nov. 14, 2008.

(51) Int. Cl.
*C23G 1/02* (2006.01)

(52) U.S. Cl. ..... 134/3; 134/2; 134/15; 134/26; 134/27; 134/28; 134/30; 134/32; 134/34; 134/36; 134/41; 134/42; 148/22; 148/113

(58) Field of Classification Search ..... 134/2, 3, 134/15, 26, 27, 28, 30, 32, 34, 36, 41, 42; 148/22, 113
See application file for complete search history.

(56) References Cited

U.S. PATENT DOCUMENTS

| | | | |
|---|---|---|---|
| 2,559,445 | A | 7/1951 | Lotz |
| 2,569,158 | A | 9/1951 | Francis |
| 3,293,159 | A | 12/1966 | Mekjean et al. |
| 3,499,735 | A | 3/1970 | Robert |
| 4,178,194 | A | 12/1979 | Azzerri et al. |
| 4,213,804 | A | 7/1980 | Datta |
| 5,061,321 | A | 10/1991 | Nishimoto et al. |
| 5,164,016 | A | 11/1992 | Henriet et al. |
| 5,185,043 | A | 2/1993 | Nishiike et al. |
| 5,354,383 | A | 10/1994 | Bianchi |
| 5,421,911 | A | 6/1995 | Schoen |
| 5,702,534 | A | 12/1997 | Rodabaugh et al. |
| 5,702,539 | A | 12/1997 | Schoen et al. |
| 5,743,968 | A | 4/1998 | Leeker et al. |
| 5,843,240 | A | 12/1998 | Pedrazzini et al. |
| 5,908,511 | A | 6/1999 | Bianchi |

(Continued)

FOREIGN PATENT DOCUMENTS

| | | |
|---|---|---|
| CS | 204318 | 4/1981 |

(Continued)

OTHER PUBLICATIONS

Sharon et al. "Mechanical properties of sintered austenitic stainless steel-effect of silicon addition", Materials Science and Engineering: A, vol. 157, Issue 2, Oct. 1, 1992, pp. 145-149.*

(Continued)

*Primary Examiner* — Bibi Carrillo
(74) *Attorney, Agent, or Firm* — Frost Brown Todd LLC

(57) ABSTRACT

The pickling process designed for pickling electrical steel strip in a continuous fashion comprising immersing the strip in at least one pickling tub. The pickling tub contains a mixture of HCl, $Fe^{2+}$, and $Fe^{3+}$ and a low concentration of HF. Upon exiting the final pickling tub, the strip may be brushed or scrubbed to loosen any residual scale to form a clean strip.

13 Claims, 2 Drawing Sheets

3-Tank Arrangement with Counter-Current Flow.

U.S. PATENT DOCUMENTS

| | | | | |
|---|---|---|---|---|
| 6,068,001 | A | 5/2000 | Pedrazzini et al. | |
| 6,210,558 | B1 | 4/2001 | Demertzis | |
| 6,250,314 | B1 * | 6/2001 | Wasserbauer et al. | 134/3 |
| 6,500,328 | B1 | 12/2002 | Fortunati et al. | |
| 6,554,908 | B1 * | 4/2003 | Negri et al. | 134/3 |
| 6,559,371 | B2 | 5/2003 | Shingleton et al. | |
| 6,565,735 | B1 * | 5/2003 | Fortunati et al. | 205/704 |
| 6,959,574 | B2 | 11/2005 | Nishi | |
| 7,011,139 | B2 | 3/2006 | Schoen et al. | |
| 7,229,506 | B2 | 6/2007 | Girdani et al. | |
| 2002/0174880 | A1 | 11/2002 | Madi et al. | |
| 2002/0179113 | A1 | 12/2002 | Madi et al. | |
| 2006/0037868 | A1 | 2/2006 | Dulcetti et al. | |
| 2006/0076247 | A1 | 4/2006 | Giordani et al. | |

FOREIGN PATENT DOCUMENTS

| | | |
|---|---|---|
| EP | 0 188 975 | 7/1986 |
| EP | 0 769 574 | 4/1997 |
| EP | 1008676 | 6/2000 |
| EP | 1 050 605 | 11/2000 |
| FR | 1533399 | 7/1968 |
| JP | 54025225 | 2/1979 |
| JP | 11019710 | 1/1999 |
| JP | 2000/254724 | 9/2000 |
| JP | 2000/282271 | 10/2000 |
| JP | 2001/226789 | 8/2001 |
| JP | 2003/027295 | 1/2003 |
| JP | 2004/050268 | 2/2004 |
| JP | 2004/202623 | 7/2004 |
| JP | 2005/200697 | 7/2005 |
| JP | 2005/202419 | 7/2005 |
| JP | 2007/217743 | 8/2007 |
| JP | 2009/013432 | 1/2009 |
| WO | WO 99/27162 | 6/1999 |
| WO | WO 02/081776 | 10/2002 |
| WO | WO 2008/141716 | 11/2008 |

OTHER PUBLICATIONS

The Stainless Steel Information Center, Specialty Steel Industry of North America, Nov. 3, 2010, pp. 1-3.*

International Search Report and Written Opinion dated May 10, 2010 for Application No. PCT/US2009/064161.

Asrar, N. et al., "Pickling silicon steels in mixed acid solutions," Metal Finishing, vol. 93(2) India (1995) pp. 70-72.

Grinberg, D.L. et al., "Characteristics of the continuous pickling of low-silicon strip steel," Cherepovets. Metal. Komb., vol. 7, USSR (1984) pp. 53-54.

Abstract of JP 54-025225.

Translation of JP 11-019710.

Translation of JP 2000-254724.

Translation of JP 2000-282271.

Translation of JP 2001-226789.

Translation of JP 2003-027295.

Translation of JP 2004-050268.

Translation of JP 2004-202623.

Translation of JP 2005-200697.

Translation of JP 2005-202419.

Translation of JP 2007-217743.

Translation of JP 2009-013432.

"Selection of Electrical Steels for Magnetic Cores," AK Steel (2007), pp. 1-28.

* cited by examiner

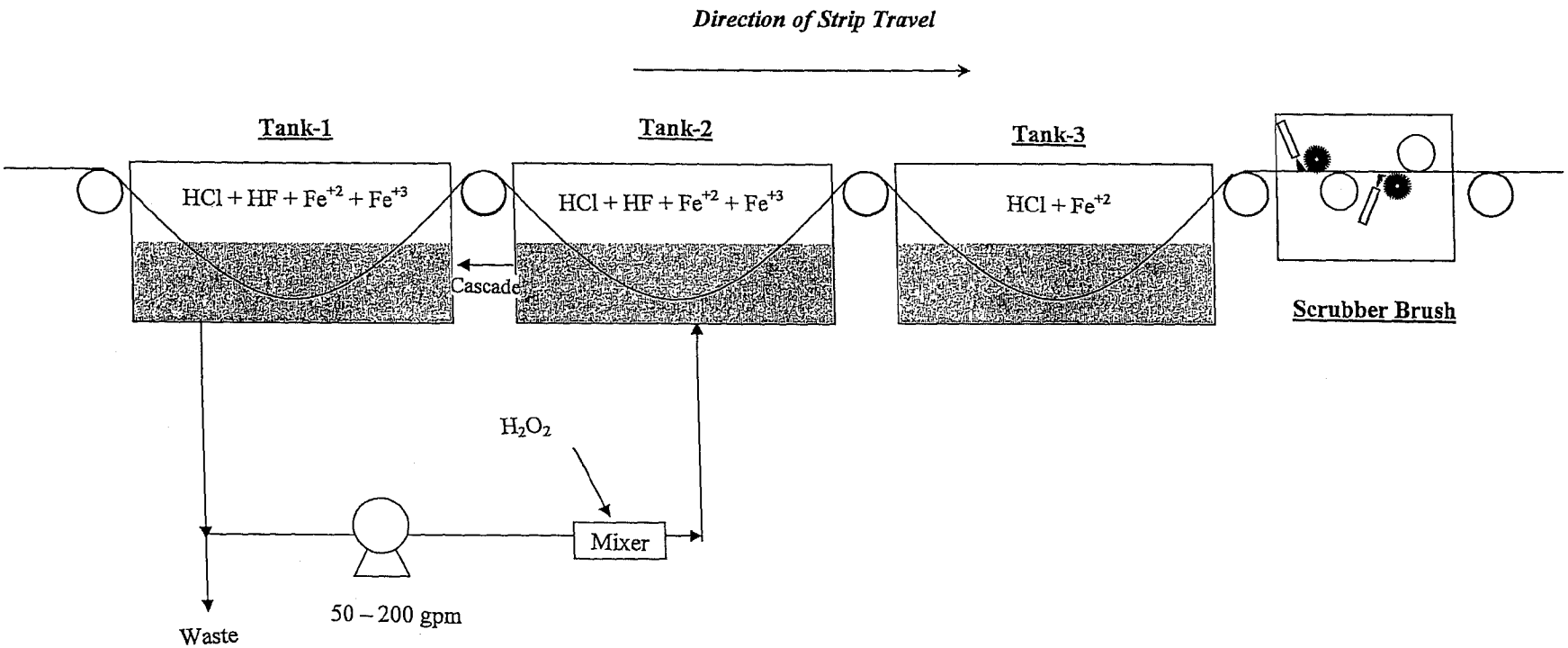
Figure 1: 3-Tank Arrangement with Counter-Current Flow.

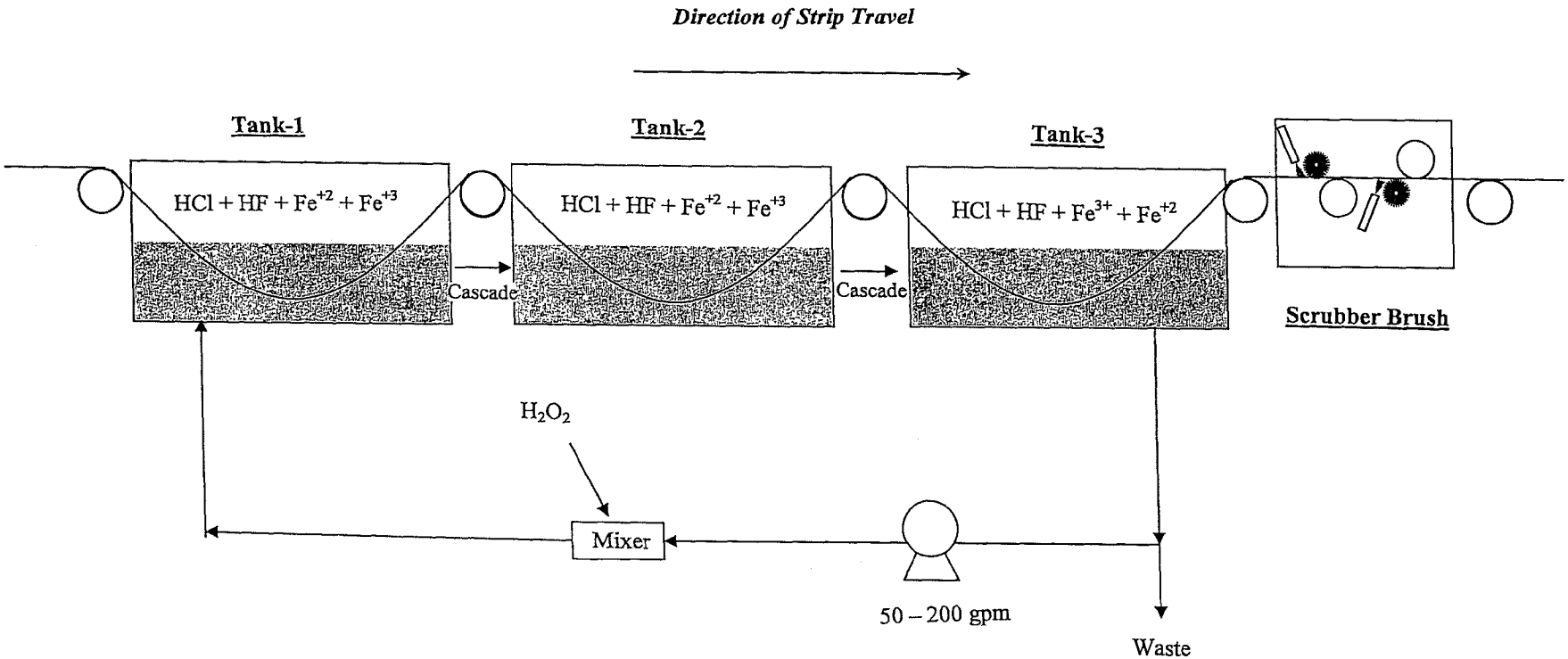
Figure 2: 3-Tank Arrangement with Co-Current Flow.

FERRIC PICKLING OF SILICON STEEL

CROSS REFERENCE TO RELATED APPLICATIONS

The present application hereby claims the benefit of the provisional patent application of the same title, Ser. No. 61/114,660, filed on Nov. 14, 2008, the disclosure of which is hereby incorporated by reference in its entirety.

BACKGROUND

Silicon-containing electrical steels are low carbon (from about 0.1% or less) specialty steels typically containing from about 0.5% to about 3.5% silicon. These steels include grain oriented and non-oriented steels. Hot processing of silicon-containing electrical steels can result in the formation of oxides on the surface of the steel strip. These oxides are primarily comprised of iron, silicon, and other associated metals, which must be removed prior to cold reduction and other subsequent processing. Traditionally, these oxides have been removed by an initial mechanical treatment such as shot blasting, which is followed by a chemical treatment such as pickling with nitric acid, or nitric acid in combination with hydrochloric acid and hydrofluoric acid.

Due to the costs of using hydrofluoric acid there is a desire for a method of pickling silicon steels that reduces the amount of the acid used.

BRIEF SUMMARY

A process for pickling steel comprising treating the steel with a mixture of HCl, $Fe^{2+}$, and $Fe^{3+}$ and a low concentration of HF.

BRIEF DESCRIPTION OF THE FIGURES

FIG. 1 is a schematic of a three tub arrangement of pickling of silicon steel where ferric ions are continuously generated in the first two tubs.

FIG. 2 is a schematic for a three tub arrangement of pickling of silicon steel where ferric ions are continuously generated in all three tubs.

DETAILED DESCRIPTION

In pickling of Si steels, oxides of iron (Fe) and Si, both, must be removed. Initial mechanical treatment such as shot blasting removes most of the surface oxide. Acid chemicals from the pickling solutions then can dissolve the remaining entrenched oxide. Acids such as HCl, nitric ($HNO_3$), and/or sulfuric ($H_2SO_4$) act to dissolve preferentially the oxides rich in Fe, whereas, HF can act to dissolve the oxides rich in Si. In prior processes, to cause the pickling reaction at the rate that is economically beneficial, the concentration of HF required was generally more than 3%, preferably more than 5%. HF is an expensive chemical. The described process reduces the concentration of HF required without negative impact on production rates by using the additional pickling power of $Fe^{+3}$ to aggressively attack Fe around Si rich oxide and thus releasing/lifting the oxide from the base metal of Si steel.

The process uses the oxidizing power of ferric iron ($Fe^{3+}$) to attack the base metal. An example of a source of the ferric iron is $FeCl_3$ added to the pickling tub. The attack of the base metal will proceed as long as a constant supply of $Fe^{3+}$ is available. The resultant ferrous iron ($Fe^{2+}$) may be oxidized back to ferric iron ($Fe^{3+}$) by the use of a chemical oxidant such as hydrogen peroxide, or any other oxidant. In addition, hydrochloric acid (HCl) is added to the pickle tub to maintain a supply of chloride ions ($Cl^-$) and proper pH. The removal of oxide may be facilitated by hydrofluoric acid (HF) that is useful for chemically milling through layers of scale containing fayalite ($FeSiO_3$), silicon-rich oxide ($SiO_2$), or both.

Hydrofluoric acid also aids in dissolution of silicates and prevents precipitation of silicic acid in the pickle liquor. During the pickling of silicon steels, the silicon that is removed during pickling may be formed into silicic acid by exposure to hydrochloric acid. Silicic acid can form a gelatinous mass that can gum up the pickled steel and the pickling tubs. The use of HF in low concentration helps to prevent silicic acid formation.

The nature of the oxides and the treatments to remove them from the base metal are dependent on the alloy composition of the base metal. The carbon steels (without significant fractions of alloying additions) form oxides rich in Fe and are external to the surface of the base metal. These oxides are easily dissolved by most acids such as HCl, $HNO_3$, or $H_2SO_4$ even without the uses of mechanical pretreatment such as shot blasting. Stainless steels are rich in chromium (Cr) and when heated they form oxides rich in Cr. The Cr rich oxide is relatively resistant/passive to attack by most acids. It requires use of combination of acids such as $HNO_3$ and HF to completely remove the oxide. The function of HF is to depassivate the protective Cr rich oxide and then allow for oxidizing acids such as $HNO_3$ to dissolve Cr depleted base metal. The chemical attack by the acid on the base metal is self-limiting when it encounters base metal with nominal Cr content.

The physical nature of the oxide on Si steels after hot processing, such as annealing, is dependent upon the content of Si in the steel. The higher Si (>2%) steels tend to form an oxide that is more external to the base metal. The lower Si (<2%) steels tend to form an oxide that is subsurface to the base metal. It is relatively easy to remove the external oxide with the combination of shot blasting and chemical pickling. The subsurface oxide is more difficult to remove because of its embedded nature.

In previous processes, such as in U.S. Pat. No. 6,599,371, $H_2O_2$ may be sprayed on the steel. Part of the $H_2O_2$ converts $Fe^{+2}$ to $Fe^{+3}$, the rest breaks down without any useful work. The produced $Fe^{+3}$ immediately reacts with the base metal to convert to $Fe^{+2}$ so no significant quantity of $Fe^{+3}$ ends up in the tub. The process described requires at least about 2% of $Fe^{+3}$ in the tub.

Iron oxide scale and metallic iron are dissolved with HCl:

$$FeO(\text{wustite})+2HCl \rightarrow FeCl_2+H_2O$$

$$Fe_2O_3(\text{magnetite})+8HCl \rightarrow FeCl_2+2FeCl_3+4H_2O$$

$$Fe_2O_3(\text{hematite})+6HCl \rightarrow 2FeCl_3+3H_2O$$

$$Fe^0(\text{metallic iron})+2HCl \rightarrow FeCl_2+H_2$$

Ferric iron ($Fe^{3+}$) can provide a pickling rate boost because it is thermodynamically more efficient. Ferric pickling causes dissolution of metallic iron and produces ferrous iron in solution without formation of hydrogen gas ($H_2$).

$$2FeCl_3+Fe^0 \rightarrow 3FeCl_2$$

The process comprises at least one pickling tub, and may comprise two or three pickling tubs. There may be additional tubs in the process that are used to rinse or clean the steel, or for other reasons. The tubs may be heated or cooled to maintain a desired temperature. In one embodiment the tubs are between about 160° F. to about 180° F. The tubs may all be at different temperatures or the same temperature.

In one embodiment, the tubs comprise a mixture of HCl, $Fe^{2+}$, and $Fe^{3+}$. The source of the ferric iron may be $FeCl_3$, or some other ferric iron source. Iron may be supplied in the ferrous oxidation state and oxidized to produce ferric iron. The source of the ferrous iron may be $FeCl_2$, or metallic iron, including that of the silicon steel itself. Iron may be supplied in a different oxidation state and oxidized or reduced to produce ferrous iron. In one embodiment the ferrous iron is derived from the ferric iron that has been reduced by the pickling process. In one embodiment the ferric iron is oxidized from ferrous iron produced by the pickling process.

In one embodiment, the amount of ferric iron in any of the tubs ranges from about 2% to about 8%, or about 4%. The amount of ferrous iron may range up to about 6%, or about 4%. The amount of ferric iron and ferrous iron in each of the tubs may be different or the same. In one embodiment, the total amount of iron ions in the tubs may not exceed about 10%.

In one embodiment, the amount of HCl in any of the tubs ranges from about 6% to about 15%, or about 10%. The amount of HCl in each of the tubs may be different or the same.

In one embodiment, the amount of HF in any of the tubs may be up to 3%, from 0.5 to 2%, from 1 to 2%, or about 1.5%. The amount of HF in each of the tubs may be different or the same.

In one embodiment, hydrogen peroxide or another oxidant, may be used to oxidize ferrous ions to ferric ions which acts as a pickling agent. The oxidation process is shown in equation 1.

$$2FeCl_2+2HCl+H_2O_2 \rightarrow 2FeCl_3+2H_2O \quad \text{(eq. 1)}$$

In one embodiment, the oxidant used to oxidize ferrous ions to ferric ions may be peroxides, such as hydrogen peroxide; peroxide acids, such as persulphuric acid; chlorine salts, such as $NaClO_2$ and $NaClO_3$; or permanganates. The oxidant may be added directly to any of the tubs, or it may be added as the mixture is recirculated to one or more other tubs.

The tubs may be agitated by bubbling air through them, or through other agitation means. Agitation methods are well known in the art.

The amounts of material measured in percentage are weight/volume percentages.

While the present disclosure has been illustrated by description of several embodiments and while the illustrative embodiments have been described in considerable detail, it is not the intention of the applicant to restrict or in any way limit the scope of the appended claims to such detail. Additional advantages and modifications may readily appear to those skilled in the art.

EXAMPLES

Example 1

Ferric Pickling

Silicon steel (1.6% Si) was cut into sample coupons of 1"×2" size. The steel was annealed and shot blasted prior to cutting into coupons. Each coupon was dipped into each beaker for 18 seconds to mimic a continuous pickling line treatment. Between dipping the coupons in each beakers, the coupons were dipped into an intermediate beaker for 3 seconds to mimic spraying. Each scheme was repeated in triplicate and the average weight loss was calculated and extrapolated per ton. Table 1 shows the pickling conditions for the metal coupons and the corresponding metal loss.

TABLE 1

Pickling Treatment of Metal Coupons and Corresponding Metal Loss

| Scheme | Beaker #1 | Spray | Beaker #2 | Spray | Beaker #3 | Weight Loss (lb/ton) |
|---|---|---|---|---|---|---|
| A | 12% HCl<br>7% HF<br>170° F. | water | 12% HCl<br>170° F. | water | 12% HCl<br>170° F. | 3.6 |
| B | 12% HCl<br>7% HF<br>170° F. | 3% $H_2O_2$ | 12% HCl<br>170° F. | 3% $H_2O_2$ | 12% HCl<br>170° F. | 6.2 |
| C | 6% HCl<br>4% $FeCl_3$<br>2% $FeCl_2$<br>140° F. | water | 12% HCl<br>170° F. | water | 12% HCl<br>170° F. | 6.7 |
| D | 6% HCl<br>4% $FeCl_3$<br>2% $FeCl_2$<br>140° F. | water | 6% HCl<br>4% $FeCl_3$<br>2% $FeCl_2$<br>140° F. | water | 12% HCl<br>170° F. | 9.3 |

Example 2

Hot rolled silicon steel (1.8% Si, and 3.25% Si in Trial A), (1.8% Si, 3% Si, and 3.25% Si in Trial B), and (3% Si in Trial C) was trial processed on three occasions on a continuous pickle line. The silicon steel was pickled in three tubs. Each tub was charged with the reagents shown in Table 2.

TABLE 2

| Pickle Tub Charging Volumes | | | | | | | |
|---|---|---|---|---|---|---|---|
| | Tub 1 | | | Tub 2 | | | Tub 3 |
| Trial | 38% $FeCl_3$ (gal) | 36% HCl (gal) | 70% HF (gal) | 38% $FeCl_3$ (gal) | 36% HCl (gal) | 70% HF (gal) | 36% HCl (gal) |
| A | 1146 | 1401 | 35 | 1146 | 1401 | 35 | 1401 |
| B | 1008 | 893 | 125 | 1008 | 893 | 125 | 1401 |
| C | 1008 | 893 | 125 | 1008 | 893 | 125 | 1401 |

After the initial setup, the tub concentrations were maintained by trickling in the required chemicals and allowing the tubs to overflow. Only the HCl concentration was controlled in Tub 3 by adding additional HCl. Any other compounds in Tub 3 were not monitored. The temperature of each tub was maintained. The average conditions during the trials are shown in Table 3. The average metal loss due to pickling was calculated from chemical use data and pickling fluid analyses.

TABLE 3

| Average Tub Conditions During Trials | | | | |
|---|---|---|---|---|
| Trial | Tub 1 | Tub 2 | Tub 3 | Average Weight Loss (lb/ton) |
| A | % HCl = 12.38<br>% HF = 0.68<br>% $Fe^{2+}$ = 2.31<br>% $Fe^{3+}$ = 3.85<br>T, ° F. = 165 | % HCl = 10.64<br>% HF = 0.63<br>% $Fe^{2+}$ = 1.92<br>% $Fe^{3+}$ = 4.07<br>T, ° F. = 164 | % HCl = 6.57<br>% $Fe^{2+}$ = 1.23<br>T, ° F. = 170 | 5.57 |
| B | % HCl = 10.82<br>% HF = 2.18<br>% $Fe^{2+}$ = 2.49<br>% $Fe^{3+}$ = 4.34<br>T, ° F. = 172 | % HCl = 10.72<br>% HF = 2.61<br>% $Fe^{2+}$ = 1.76<br>% $Fe^{3+}$ = 3.81<br>T, ° F. = 172 | % HCl = 9.30<br>% $Fe^{2+}$ = 2.01<br>T, ° F. = 170 | 8.18 |
| C | % HCl = 10.08<br>% HF = 1.95<br>% $Fe^{2+}$ = 2.05<br>% $Fe^{3+}$ = 3.36<br>T, ° F. = 166 | % HCl = 10.82<br>% HF = 2.12<br>% $Fe^{2+}$ = 2.05<br>% $Fe^{3+}$ = 4.47<br>T, ° F. = 171 | % HCl = 10.71<br>% $Fe^{2+}$ = 2.15<br>T, ° F. = 170 | 7.62 |

Example 3

Hot rolled silicon steels with varying levels of Si were processed on a continuous anneal and pickle line. The silicon steels were pickled in three tubs. The pickling chemistries for each of the Si steels in each of the tubs are shown in Table 4. The tub concentrations were maintained by trickling in the required chemicals and allowing the pickling fluid to cascade from Tub 1 to Tub 2 to Tub 3 and then re-circulating the fluid back in to Tub 1. A controlled quantity of hydrogen peroxide was injected in the re-circulation pipe to convert ferrous to ferric ions. The average conditions for Tub 1 and Tub 2 during the processing are shown in Table 4.

TABLE 4

| Average Tub Conditions During Processing | |
|---|---|
| Silicon Steel Type | Pickling Conditions |
| Non-Oriented (1.8% Si) | % HCl = 10.5-11<br>% HF = 1.14-1.56<br>% $Fe^{2+}$ = 3.8-4.8<br>% $Fe^{3+}$ = 3.4-2.6<br>T, ° F. = 160-180 |
| Oriented Type-1 (3.25% Si) | % HCl = 9.85-10.60<br>% HF = 0.77-1.23<br>% $Fe^{2+}$ = 4.2-5.3<br>% $Fe^{3+}$ = 2.8-3.6<br>T, ° F. = 160-180 |
| Oriented Type-2 (3% Si) | % HCl = 10.1-10.8<br>% HF = 0.84-1.25<br>% $Fe^{2+}$ = 4.3-5.0<br>% $Fe^{3+}$ = 3.5-2.8<br>T, ° F. = 160-180 |

What is claimed is:

1. A process for pickling silicon-containing electrical steel comprising treating the silicon-containing electrical steel with a mixture comprising HCl, HF, $Fe^{3+}$, and $Fe^{2+}$, wherein the concentration of HF is less than 3 weight %; and wherein the concentration of $Fe^{3+}$ is not less than about 2 weight %.

2. The process of claim 1, where the concentration of the $Fe^{3+}$ is from about 2 weight % to about 8 weight %.

3. The process of claim 1, where the concentration of HCl is from about 6 weight % to about 15 weight %.

4. The process of claim 1, where the concentration of HF is from 1 to 2 weight %.

5. The process of claim 1, where the concentration of HF is about 1.5 weight %.

6. The process of claim 1, where the concentration of $Fe^{2+}$ is less than about 6 weight %.

7. The process of claim 1, where hydrogen peroxide is not sprayed onto the steel.

8. The process of claim 1, where the steel is pickled in a continuous fashion.

9. The process of claim 1, where the temperature of the mixture is not less than about 140° F.

10. The process of claim 1, where the temperature of the mixture is not less than about 150° F.

11. The process of claim 1, where the silicon-containing electrical steel comprises less than 2 weight % silicon.

12. The process of claim 1, where the silicon-containing electrical steel comprises about 3 weight % silicon.

13. A pickling process for silicon-containing electrical steel comprising the steps of:

placing the silicon-containing electrical steel in a pickling tub kept at a temperature ranging from about 165° F. to about 180° F. containing a mixture comprising $Fe^{3+}$, HF, and HCl; where the tub is agitated, the mixture is continuously or periodically fed with an oxidant, HF, and HCl.

* * * * *